US010697144B2

(12) United States Patent
Kimura et al.

(10) Patent No.: US 10,697,144 B2
(45) Date of Patent: Jun. 30, 2020

(54) ROTATION BEARING OF FLAP GATE AND FLAP GATE

(71) Applicant: HITACHI ZOSEN CORPORATION, Osaka-shi, Osaka (JP)

(72) Inventors: Yuichiro Kimura, Osaka (JP); Kunie Miyamoto, Osaka (JP); Toshiaki Morii, Osaka (JP); Yoshito Yamakawa, Osaka (JP); Kyoichi Nakayasu, Osaka (JP)

(73) Assignee: Hitachi Zosen Corporation, Osaka (JP)

( * ) Notice: Subject to any disclaimer, the term of this patent is extended or adjusted under 35 U.S.C. 154(b) by 0 days.

(21) Appl. No.: 16/337,648

(22) PCT Filed: Jun. 6, 2017

(86) PCT No.: PCT/JP2017/020969
§ 371 (c)(1),
(2) Date: Mar. 28, 2019

(87) PCT Pub. No.: WO2018/061324
PCT Pub. Date: Apr. 5, 2018

(65) Prior Publication Data

US 2019/0345684 A1 Nov. 14, 2019

(30) Foreign Application Priority Data

Sep. 30, 2016 (JP) ..... 2016-192388

(51) Int. Cl.
*E02B 7/44* (2006.01)
*E02B 7/20* (2006.01)
(Continued)

(52) U.S. Cl.
CPC ..... *E02B 7/44* (2013.01); *E02B 7/205* (2013.01); *E05D 3/06* (2013.01); *E02B 7/54* (2013.01); *E05Y 2900/116* (2013.01)

(58) Field of Classification Search
CPC combination set(s) only.
See application file for complete search history.

(56) References Cited

U.S. PATENT DOCUMENTS

2003/0190193 A1 10/2003 Waters, Jr.
2012/0219360 A1* 8/2012 Morii ..... E02B 7/44 405/100

(Continued)

FOREIGN PATENT DOCUMENTS

JP 11-050437 A 2/1999
JP 2004-353236 A 12/2004

(Continued)

OTHER PUBLICATIONS

International Search Report PCT/JP2017/020969 dated Jul. 4, 2017 with English translation.

(Continued)

*Primary Examiner* — Kyle Armstrong
(74) *Attorney, Agent, or Firm* — Pillsbury Winthrop Shaw Pittman, LLP

(57) ABSTRACT

An axis positioning mechanism serving as a rotation bearing of a flap gate includes a housing disposed at the bottom of an opening, a first rotating plate rotationally supported by the housing via a first shaft, a second rotating plate rotationally supported by the housing via a second shaft having a different axis from the first shaft, and a synchronizing rod rotationally connected to the rotating plates so as to synchronize the rotations of the rotating plates. The axis positioning mechanism further includes connecting members rotationally connecting a door base and the rotating plates (Continued)

with different axes. The door is laid flat with a pivot at a higher position than the axes.

11 Claims, 12 Drawing Sheets

(51) Int. Cl.
*E05D 3/06* (2006.01)
*E02B 7/54* (2006.01)

(56) References Cited

U.S. PATENT DOCUMENTS

2012/0237297 A1* 9/2012 Morii ..... E02B 7/44 405/21
2012/0294678 A1* 11/2012 Nakayasu ..... E02B 3/102 405/96
2015/0299973 A1* 10/2015 Nakayasu ..... E02B 7/54 405/16
2017/0292238 A1 10/2017 Morii et al.

FOREIGN PATENT DOCUMENTS

JP 2005-163461 A 6/2005
JP 2007-308936 A 11/2007
JP 5580785 B 1/2013
WO 2016084433 A1 6/2016

OTHER PUBLICATIONS

Extended European Search Report issued in corresponding European Patent Application No. 17855283.2, dated Apr. 29, 2020.

* cited by examiner

ROTATION BEARING OF FLAP GATE AND FLAP GATE

CROSS-REFERENCE TO RELATED APPLICATIONS

This application is the U.S. National Phase of PCT/JP2017/020969, filed Jun. 6, 2017, which claims the benefit of priority from Japanese Patent Application Serial No. 2016-192388 filed Sep. 30, 2016, the contents of each of which are hereby incorporated by reference in entirety.

TECHNICAL FIELD

The present invention relates to a flap gate installed to stop a water flow at an opening that may allow the intrusion of water.

BACKGROUND ART

Flap gates with relatively simple hinge structures for operations have been recently developed in forms that do not need manual operations, so that flap gates have received attention as flood-control measures. Particularly in recent years, the number of installed flap gates has increased because of the usability of flap gates and a growing awareness of disaster prevention.

In such a flap gate, a door base and the hinge structure of a substrate pivotally supporting the door base enable an operation for flapping a door. Moreover, a watertight rubber sheet for ensuring watertightness is fixed from the door base to the hinge structure substrate. If the watertight rubber sheet is separated from the pivot of a door for flapping, the watertight rubber may sag in a raised position of the door (for example, see FIG. 8 of Patent Literature 1). Thus, a structure in which the pivot of a door for flapping is disposed near (or in) a watertight rubber sheet is proposed (for example, see FIG. 1 of Patent Literature 1). As shown in FIGS. 14 and 15, a simple structure described in Patent Literature 1 has a door base 330 that is partially cylindrical and is pivotally supported by a bearing stand 302 serving as a substrate (via an oilless bush 340). With this structure, as shown in FIG. 15, even the door base 330 in a raised position does not sag the watertight rubber sheet 12. Thus, a door-side cross arm brace 14 for fixing the watertight rubber sheet 12 with countersunk bolts 16 and a substrate-side cross arm brace 15 are brought close to each other, thereby reducing the area of the watertight rubber sheet 12 exposed from the cross arm braces 14 and 15.

CITATION LIST

Patent Literature

Patent Literature 1: Japanese Patent No. 5580785

SUMMARY OF INVENTION

Technical Problem

In the case of the rotation bearing of the flap gate illustrated in FIGS. 14 and 15, the curvatures of the door base 330 and the bearing stand 302 are adjusted such that a pivot 20 of the door for flapping is located near the watertight rubber sheet 12 (in the watertight rubber sheet 12 in the illustrated example). This adjustment requires high accuracy. Furthermore, the door base 330 and the bearing stand 302 are formed by cutting a metallic material and thus the manufacture of the door base 330 and the bearing stand 302 requires considerable work.

An object of the present invention is to provide a rotation bearing of a flap gate and a flap gate that can achieve a simple manufacturing process.

Solution to Problem

In order to solve the problem, a rotation bearing of a flap gate according to a first invention is a rotation bearing of a flap gate provided at the opening of a structure, the rotation bearing including:

a housing disposed at a bottom of the opening;

a door base disposed at a flapping door of the flap gate;

a first rotating member rotationally supported by the housing via a first shaft;

a second rotating member rotationally supported by the housing via a second shaft having a different axis from the first shaft;

a synchronizing member rotationally connected to the first rotating member and the second rotating member so as to synchronize rotations of the first rotating member and the second rotating member; and connecting members that rotationally connect the door base to the first rotating member and the second rotating member with different axes, wherein the door is laid flat with a pivot at a higher position than the axes for rotationally connecting the connecting members to the door base.

Moreover, a rotation bearing of a flap gate according to a second invention, in the rotation bearing of the flap gate according to the first invention, including:

a first connecting member rotationally connecting the door base and the first rotating member;

a second connecting member rotationally connecting the door base and the second rotating member; and a third connecting member rotationally connecting the door base and the first rotating member and the synchronizing member at a different position from the first connecting member, wherein the door base and the first connecting member are connected via a first door-side pin while the first rotating member and the first connecting member are connected via a first connecting pin, the door base and the second connecting member are connected via a second door-side pin while the second rotating member and the second connecting member are connected via a second connecting pin, the door base and the third connecting member are connected via a third door-side pin while the first rotating member and the third connecting member and the synchronizing member are connected via a first synchronizing pin, the second rotating member and the synchronizing member are connected via a second synchronizing pin, an angle formed by the first door-side pin, the pivot of the door, and the third door-side pin is set equal to an angle formed by the first connecting pin, the first shaft, and the first synchronizing pin, an angle formed by the second door-side pin, the pivot of the door, and the third door-side pin is set equal to an angle formed by the second connecting pin, the second shaft, and the second synchronizing pin, and a distance between the pivot of the door and the first door-side pin, the second door-side pin, and the third door-side pin is set equal to a distance between the first shaft and the first connecting pin and the first synchronizing pin and a distance between the second shaft and the second connecting pin and the second synchronizing pin.

A rotation bearing of a flap gate according to a third invention, wherein the connecting member in the rotation bearing of the flap gate according to the first invention also serves as the synchronizing member.

A rotation bearing of a flap gate according to a fourth invention, wherein the first and second shafts in the rotation bearing of the flap gate according to any one of the first to third inventions are placed above a position where the first rotating member and the second rotating member are rotationally connected to the synchronizing member while the door is laid flat.

A rotation bearing of a flap gate according to a fifth invention, wherein the first shaft and the second shaft in the rotation bearing of the flap gate according to any one of the first to third inventions have both ends supported by the housing.

A flap gate according to a sixth invention includes:

the rotation bearing of the flap gate according to any one of the first to third inventions;

a substrate provided at the bottom of the opening;

the door configured with the door base so as to flap with respect to the substrate; and a watertight elastic sheet disposed from the door base to the substrate.

Advantageous Effects of Invention

The rotation bearing of the flap gate and the flap gate eliminate the need for cutting the door base with high accuracy during manufacturing, thereby simplifying the manufacturing process.

DESCRIPTION OF EMBODIMENTS

First Embodiment

A flap gate according to a first embodiment of the present invention will be described below in accordance with the accompanying drawings. The present invention relates to a flap gate installed to stop a water flow at an opening that may allow the intrusion of water. The flap gate may be referred to as a derricking-motion flap gate.

Figure 1:
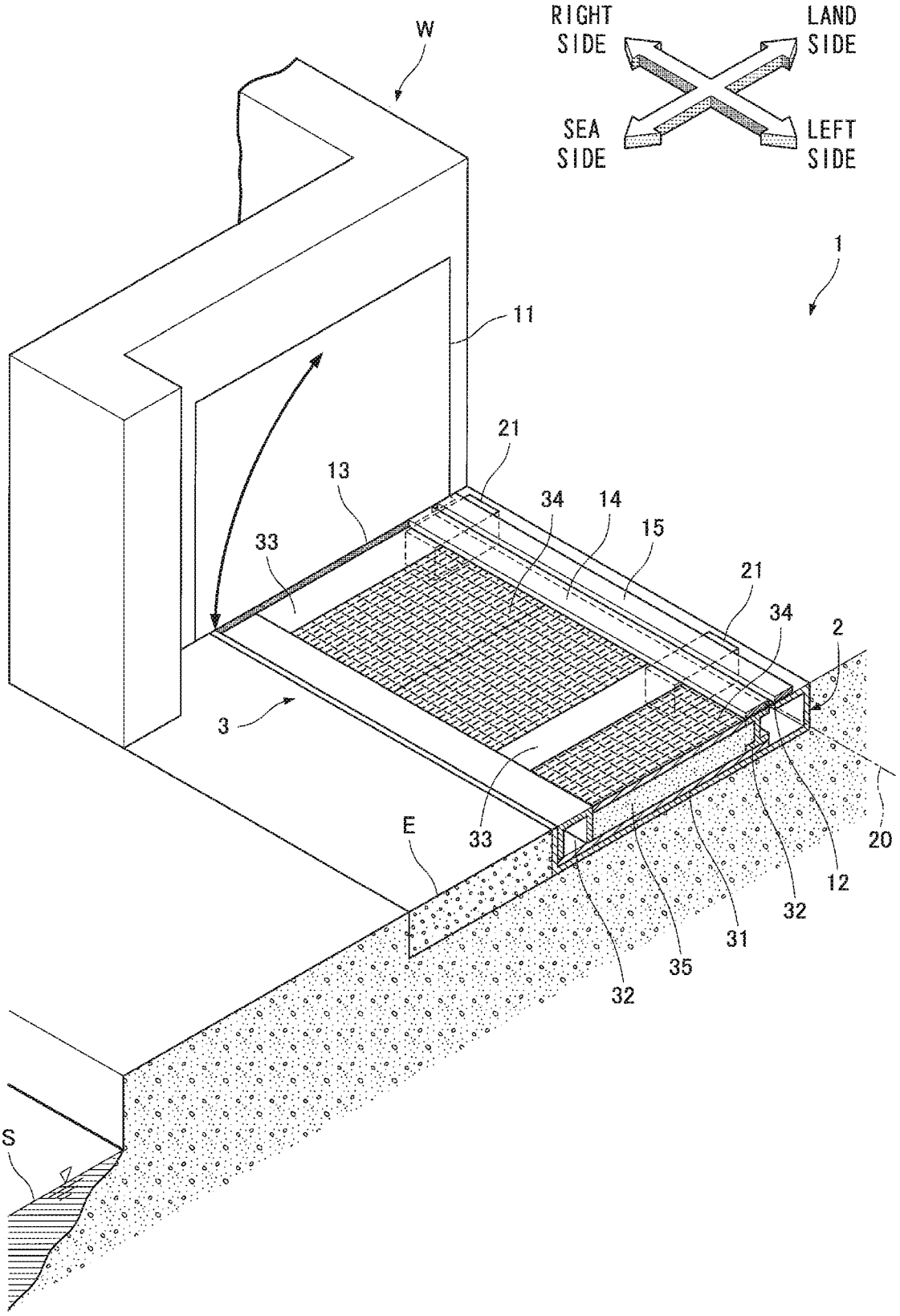
FIG. 1 is a schematic perspective view of a flap gate under normal conditions according to a first embodiment of the present invention.
Figure 2:
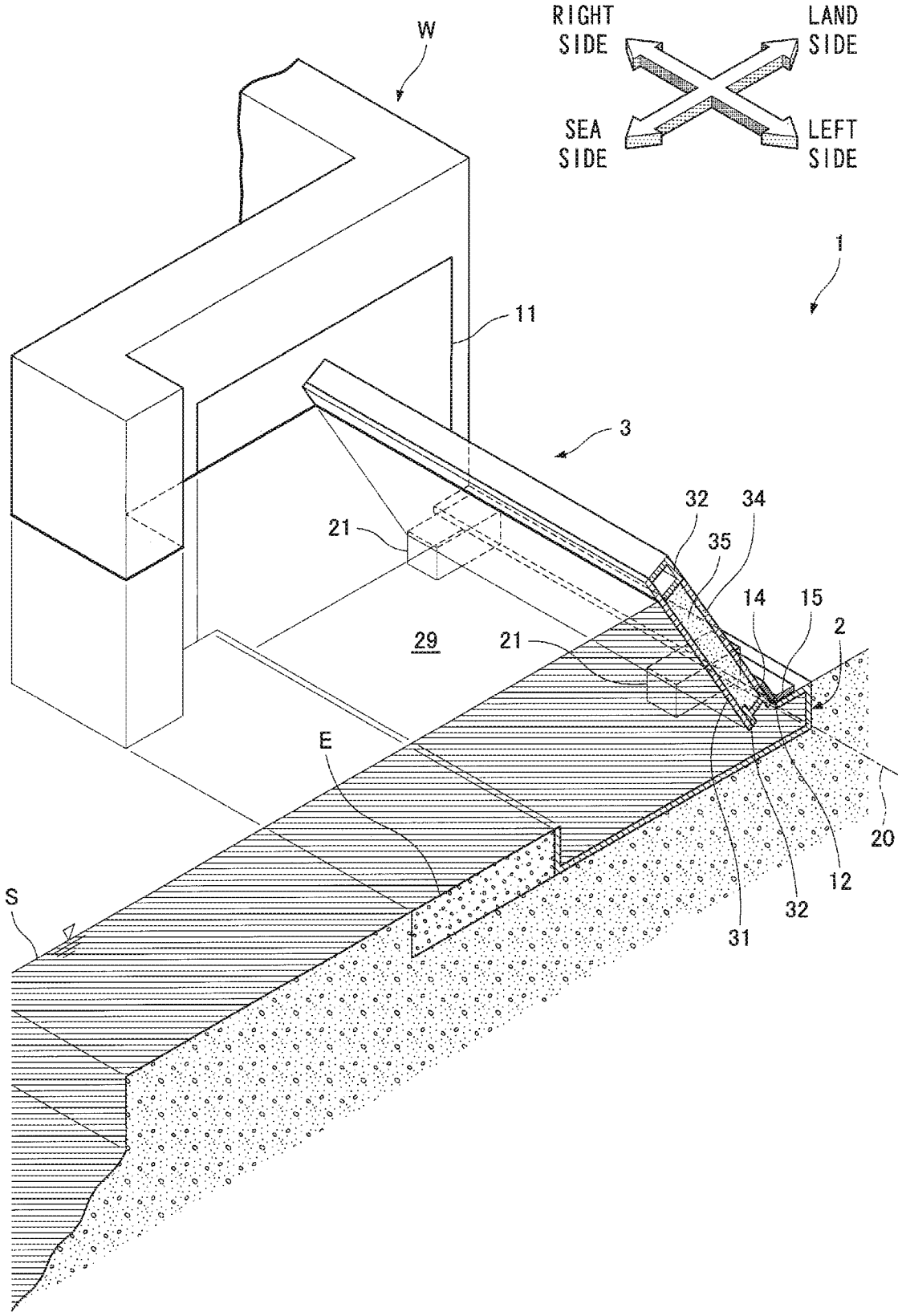
FIG. 2 is a schematic perspective view of the flap gate under emergency conditions.

As shown in FIGS. 1 and 2, a flap gate 1 is installed to stop a water flow at an opening E that may (is expected to) allow the intrusion of water into a structure W. The flap gate 1 is installed at, for example, the opening of a seawall or the entrance of a building. Hereinafter, the flap gate 1 for the opening of a seawall will be described for the sake of simplicity. The structure W is, for example, the entrance wall of a building or a seawall that stops a water flow with the flap gate 1 at the opening E.

As shown in FIGS. 1 and 2, the flap gate 1 is installed on a road surface (opening E) between coastal water walls W. As shown in FIG. 1, under normal conditions, that is, when a sea level S does not exceed the road surface, the flap gate 1 is kept flat so as to constitute the road surface of the opening E. As shown in FIG. 2, under emergency circumstances, that is, when the sea level S exceeds the road surface, the flap gate 1 rises to block sea water until the upper end of the flap gate 1 becomes higher than the sea level S. Since the flap gate 1 blocks sea water, as shown in FIG. 2, a road surface on the sea side of the flap gate 1 is submerged into water but a road surface on the land side of the flap gate 1 is not submerged into water. FIGS. 1 and 2 are perspective views, each illustrating the longitudinal section and the right side of the flap gate 1. Thus, the configurations of the water wall W and the flap gate 1 are naturally provided also on the left side. The configurations on the left side are identical to those of the right side.

Typically, flap gates include an opening/closing flap gate that is raised using a hydraulic pressure, an air pressure, or the power of a hoisting machine or the like and a floating flap gate raised using the buoyant force of the flap gate. A floating flap gate is advantageously raised by a buoyant force under automatic operations when water flows to the flap gate, that is, under emergency circumstances. For the sake of simplicity, the flap gate 1 of the first embodiment will be described as a floating flap gate, though the flap gate 1 is not limited to a floating flap gate.

The schematic configuration of the floating flap gate 1 according to the first embodiment of the present invention will be first described below.

As shown in FIGS. 1 and 2, the flap gate 1 includes a substrate 2 installed at the bottom of the opening E, a door 3 raised relative to the substrate 2, and a side door stop 11 disposed on the water wall W so as to face one side of the door 3. As shown in FIG. 1, the flap gate 1 further includes, as members for ensuring watertightness between the door 3 and the substrate 2 and the water wall W, a lower watertight rubber sheet 12 (an example of a watertight elastic sheet, will be simply referred to as the watertight rubber sheet 12) that is disposed from a door base 30 to the substrate 2 and side watertight rubber 13 that is disposed on one side of the door 3 and comes into contact with the side door stop 11. The watertight rubber sheet 12 is pressed and fixed to the door 3 by a cross arm brace 14 (hereinafter will be referred to as a door-side cross arm brace 14) disposed on the door base 30 and is pressed and fixed to the substrate 2 by a cross arm brace 15 (hereinafter will be referred to as a substrate-side cross arm brace 15) disposed on the substrate 2. The side watertight rubber 13 is fixed to one side of the door 3 by a fixing member, which is not shown.

The substrate 2 is configured with, as shown in FIGS. 1 and 2, the upper end face flush with the road surface of the opening E. As shown in FIG. 2, the substrate 2 has a space 29 that stores the door 3 that is laid flat. As shown in FIG. 1, the upper end face of the flat door 3 stored in the space 29 is flush with the road surface.

The door 3 includes a skin plate 31 that directly receives sea water flowing into the opening E when the sea level S is increased by a tidal wave or a tsunami, cross beams 32 and stringer beams 33 that reinforce the skin plate 31, a checkered steel plate 34 that is disposed between the stringer beams 33 and serves as the upper end face of the flat door 3, and a plastic foam 35 provided as a filler between the checkered steel plate 34 and the skin plate 31.

Figure 14:
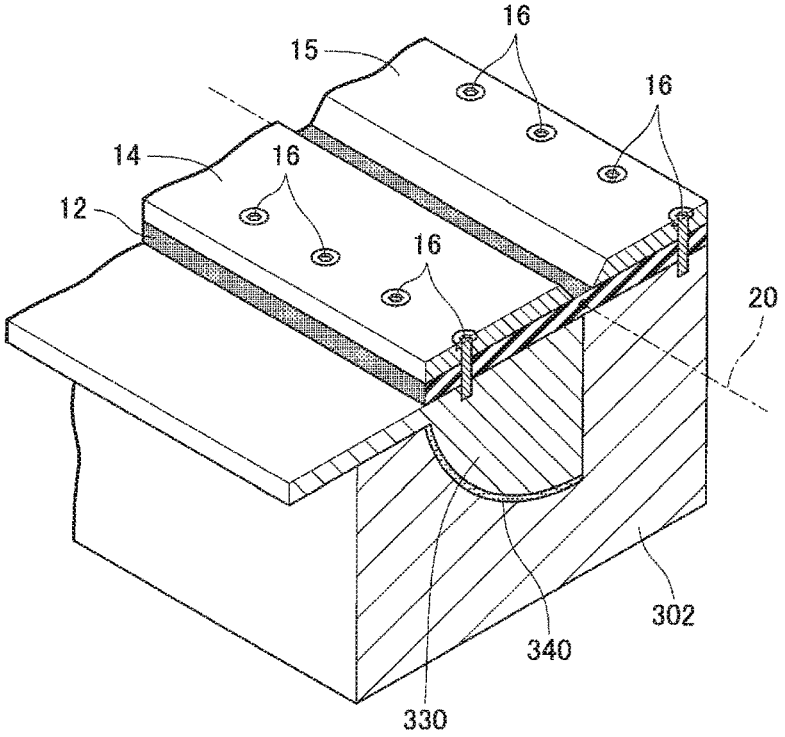
FIG. 14 is a perspective view of a door base being laid flat and a bearing stand (base) in a flap gate of the related art.
Figure 15:
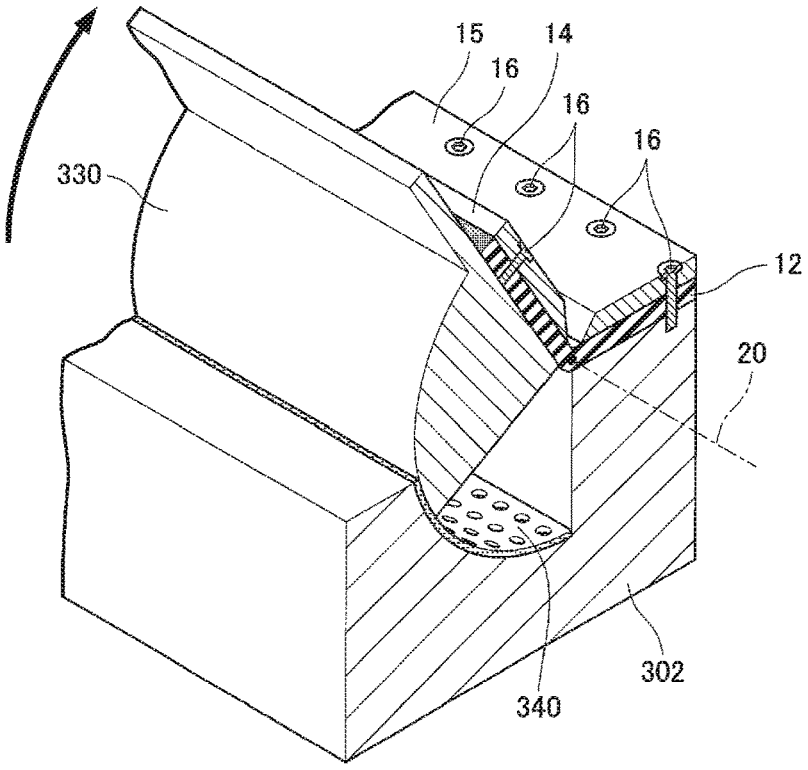
FIG. 15 is a perspective view of the door base being raised and the bearing stand (base) in the flap gate of the related art.

As shown in FIGS. 1 and 2, in the flap gate 1, the pivot 20 of the door 3 for flapping is located in the watertight rubber sheet 12 (or near the watertight rubber sheet 12). In order to locate the pivot 20 of the door 3 near or in the watertight rubber sheet 12, the door base 330 in the configuration of the related art illustrated in FIGS. 14 and 15 is partially cut into a cylindrical shape pivotally supported on the bearing stand 302, whereas in the present invention, axis positioning mechanisms 21 are used with simple configurations illustrated in FIGS. 1 and 2. In other words, the axis positioning mechanism 21 serves as the rotation bearing of the flap gate 1 and the gist of the present invention. As shown in FIG. 1, the axis positioning mechanism 21 is located at consecutive positions from the stringer beam 33 of the door 3 to the land side.

Referring to FIGS. 3 to 9, the axis positioning mechanism 21 serving as the gist of the present invention will be described in detail.

Figure 3:
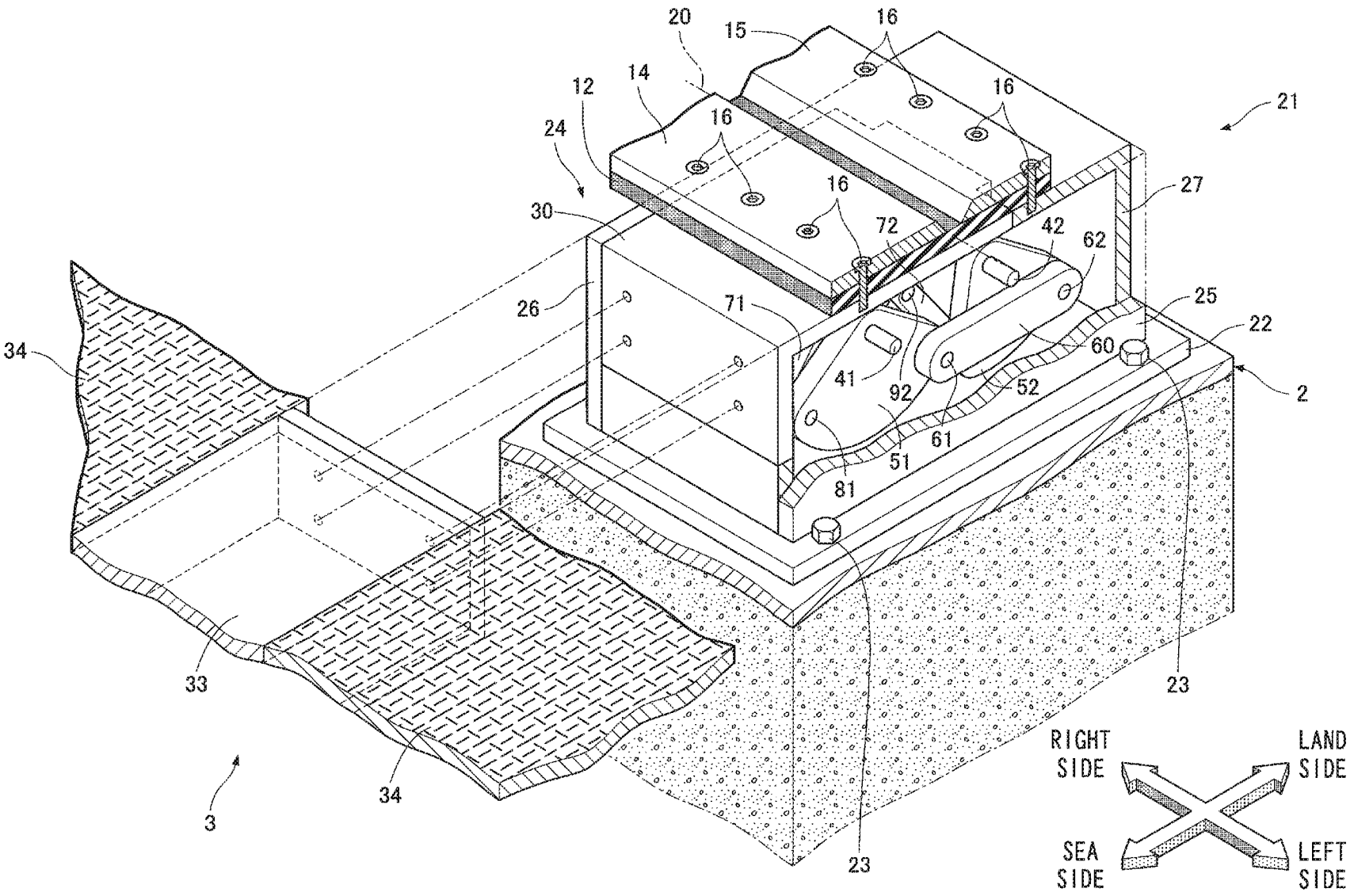
FIG. 3 is an enlarged perspective view illustrating an axis positioning mechanism for the flap gate and the peripheral configuration of the mechanism.

As shown in FIG. 3, the axis positioning mechanism 21 has a substrate plate 22 for fixation to the ground (the bottom of the opening E) via the substrate 2 and a housing 24 placed on the substrate plate 22. The substrate plate 22 is a plate for fixation with anchor bolts 23 to the ground (concrete) where the substrate 2 is installed. The top surface and the sea-side surface of the housing 24 are opened. The housing 24 has a left plate 25 and a right plate 26 on the left and right sides and a land-side plate 27 on the land side. Moreover, the housing 24 stores members for placing the pivot 20 of the door 3 for flapping near or in the watertight rubber sheet 12 with the left plate 25, the right plate 26, and the land-side plate 27. In FIG. 3, the left plate 25 of the housing 24 is partially cut for viewing of the members stored in the housing 24.

The axis positioning mechanism 21 has the door base 30 disposed over the top surface and the sea-side surface of the housing 24 as illustrated in FIG. 3. The door base 30 is connected to the stringer beam 33 of the door 3 with bolts and nuts (not shown). The watertight rubber sheet 12 is fixed to the top surface of the door base 30 with multiple countersunk bolts 16 while being pressed by the door-side cross arm brace 14 and the substrate-side cross arm brace 15.

Figure 4:
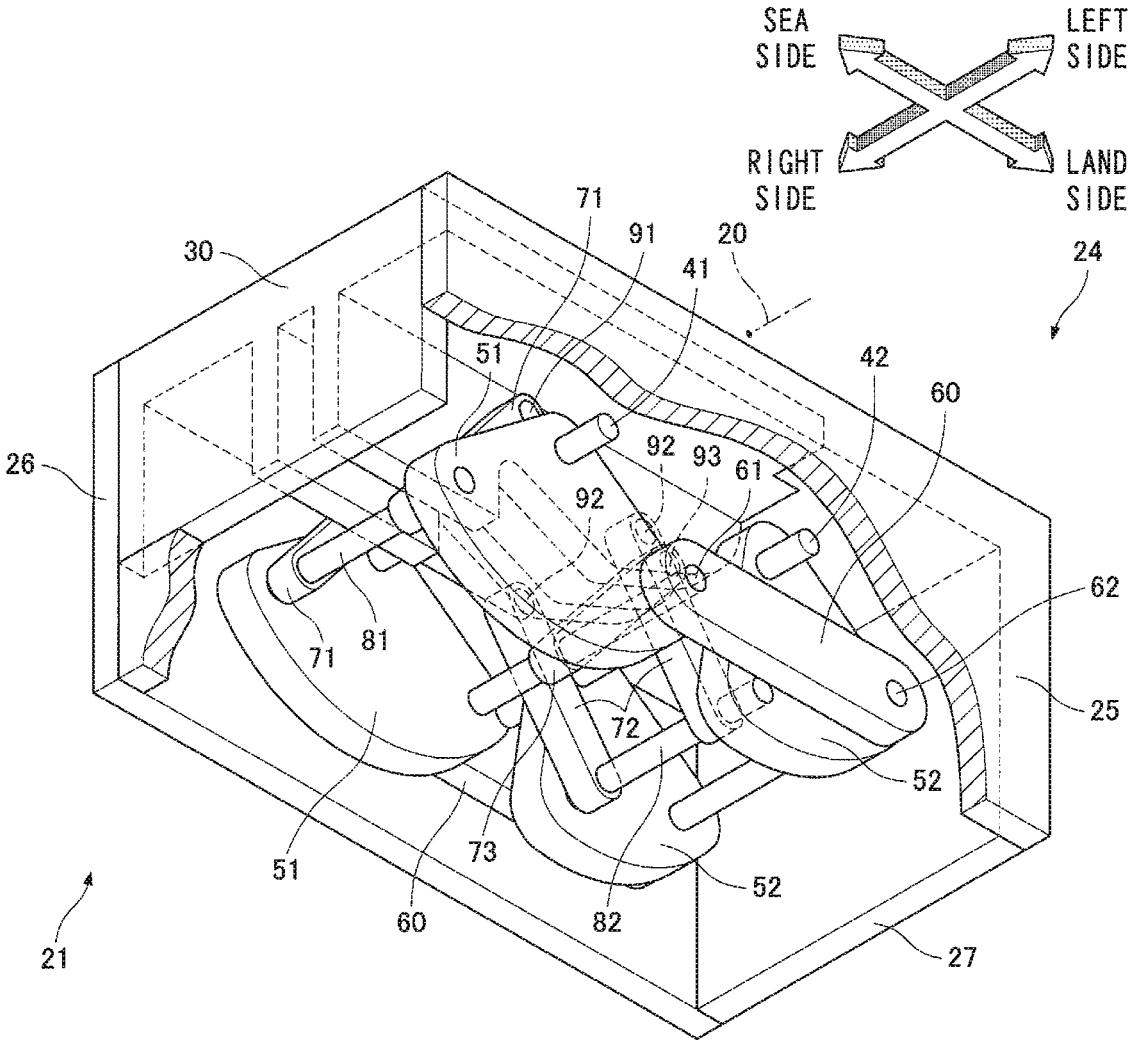
FIG. 4 is an enlarged perspective view illustrating the axis positioning mechanism viewed from the lower left.
Figure 5:
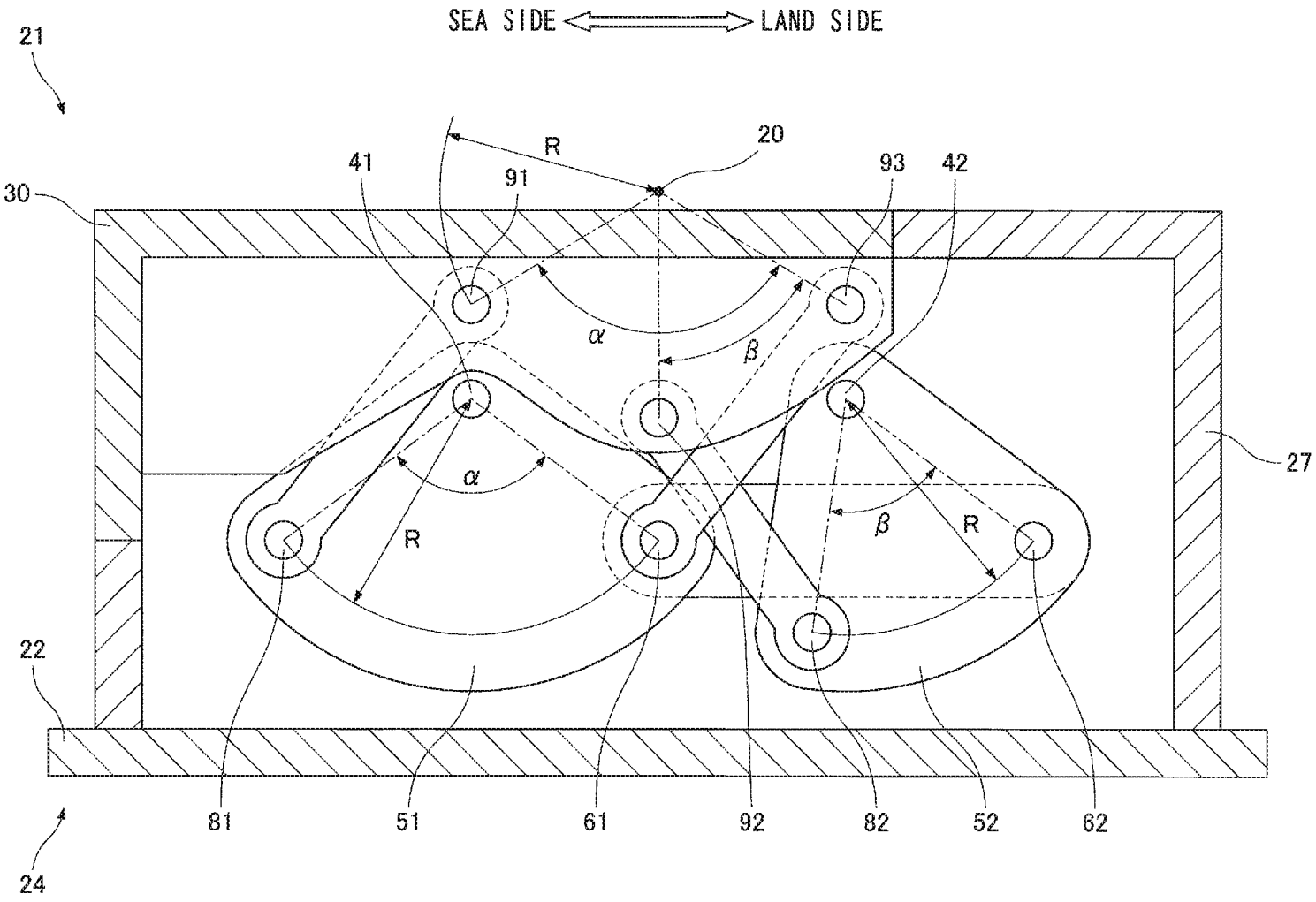
FIG. 5 is an enlarged longitudinal section illustrating a housing of the axis positioning mechanism viewed from a laterally extending center plane.

Referring to FIGS. 4 and 5, the members stored in the housing 24 in FIG. 3 will be specifically described below. FIG. 4 illustrates the housing 24 viewed from the lower left side.

As shown in FIGS. 3 to 5, the members include a first shaft 41 and a second shaft 42 with both ends supported by the left plate 25 and the right plate 26 of the housing 24, first rotating plates 51 (an example of a first rotating member) rotationally supported by the housing 24 via the first shaft 41, and second rotating plates 52 (an example of a second rotating member) rotationally supported by the housing 24 via the second shaft 42. The first shaft 41 and the second shaft 42 have different axes but the axes are disposed in parallel with the pivot 20 of the door 3.

The members further include, as shown in FIGS. 3 to 5, synchronizing rods 60 (an example of a synchronizing member), each synchronizing the rotation of the first rotating plate 51 about the first shaft 41 and the rotation of the second rotating plate 52 about the second shaft 42. In the present invention, "synchronizing the rotations of the two members" means that the two members are rotated in the same direction. The synchronizing rod 60 includes a first synchronizing pin 61 that rotationally connects the first rotating plate 51 and a second synchronizing pin 62 that rotationally connects the second rotating plate 52. The first synchronizing pin 61 and the second synchronizing pin 62 have different axes but the axes are disposed in parallel with the pivot 20 of the door 3. In order to synchronize the rotations of the first rotating plate 51 and the second rotating plate 52 by means of the synchronizing rod 60, for example, a distance between the first shaft 41 and the first synchronizing pin 61 is set equal to a distance between the second shaft 42 and the second synchronizing pin 62 and a distance between the first shaft 41 and the second shaft 42 is set equal to a distance between the first synchronizing pin 61 and the second synchronizing pin 62. In other words, even when the first rotating plate 51 and the second rotating plate 52 rotate, a line connecting the first shaft 41 and the second shaft 42 and a line connecting the first synchronizing pin 61 and the second synchronizing pin 62 are kept in parallel with each other.

As shown in FIGS. 3 to 5, the members further include first connecting rods 71 each of which connects the first rotating plate 51 and the door base 30 and second connecting rods 72 each of which connects the second rotating plate 52 and the door base 30. The first connecting rod 71 includes a first connecting pin 81 that rotationally connects the first rotating plate 51 and a first door-side pin 91 that rotationally connects the door base 30. The second connecting rod 72 includes a second connecting pin 82 that rotationally connects the second rotating plate 52 and a second door-side pin 92 that rotationally connects the door base 30. The first connecting pin 81, the first door-side pin 91, the second connecting pin 82, and the second door-side pin 92 have different axes but the axes are disposed in parallel with the pivot 20 of the door 3. In other words, it can be said that the door base 30 is rotationally connected to the first rotating plates 51 and the second rotating plates 52 with different axes (via the first connecting rod 71 and the second connecting rod 72). Furthermore, the members include a third connecting rod 73 that connects the first rotating plate 51 and the door base 30 at a different position from the first connecting rod 71. The third connecting rod 73 is connected to the first rotating plate 51 via the first synchronizing pin 61 and includes a third door-side pin 93 that rotationally connects the door base 30. The third door-side pin 93 also has a different axis from the first connecting pin 81, the first door-side pin 91, the second connecting pin 82, and the second door-side pin 92 but the axis is disposed in parallel with the pivot 20 of the door 3. In the layout of the members, the door 3 laid flat has the pivot 20 at a higher position than the first door-side pin 91, the second door-side pin 92, and the third door-side pin 93. With this configuration, the pivot 20 of the door 3 is closer to the watertight rubber sheet 12 than the first door-side pin 91, the second door-side pin 92, and the third door-side pin 93. In other words, the pivot 20 of the door 3 is placed near the watertight rubber sheet 12 (or in the watertight rubber sheet 12).

On the first rotating plate 51, as shown in FIG. 5, the first shaft 41 is placed higher than the first connecting pin 81 and the first synchronizing pin 61, the first synchronizing pin 61 is placed on the land side of the first shaft 41 and the first connecting pin 81, and the first connecting pin 81 is placed on the sea side of the first shaft 41 and the first synchronizing pin 61 while the door 3 is laid flat. On the second rotating plate 52, the second shaft 42 is placed higher than the second connecting pin 82 and the second synchronizing pin 62, the second synchronizing pin 62 is placed on the land side of the second shaft 42 and the second connecting pin 82, and the second connecting pin 82 is placed on the sea side of the second shaft 42 and the second synchronizing pin 62 while the door 3 is laid flat. In the door base 30, the first door-side pin 91, the second door-side pin 92, and the third door-side pin 93 are disposed at positions where a rotation about the pivot 20 and the rotations of the first rotating plate 51 and the second rotating plate 52 are synchronized with each other.

The first door-side pin 91, the second door-side pin 92, and the third door-side pin 93 in this layout will be specifically described below. As shown in FIG. 5, an angle $\alpha$ formed by the first door-side pin 91, the pivot 20 of the door 3, and the third door-side pin 93 is equal to an angle $\alpha$ formed by the first connecting pin 81, the first shaft 41, and the first synchronizing pin 61. An angle $\beta$ formed by the second door-side pin 92, the pivot 20 of the door 3, and the third door-side pin 93 is equal to an angle $\beta$ formed by the second connecting pin 82, the second shaft 42, and the second synchronizing pin 62. Additionally, a distance R between the pivot 20 of the door 3 and the first door-side pin 91, the second door-side pin 92, and the third door-side pin 93 is equal to a distance R between the first shaft 41 and the first connecting pin 81 and the first synchronizing pin 61 and a distance R between the second shaft 42 and the second connecting pin 82 and the second synchronizing pin 62. The angle $\alpha$ and the angle $\beta$ may be equal to each other. In this case, the first door-side pin 91 rotationally connecting the door base 30 to the first connecting rod 71 also serves as the second door-side pin 92 rotationally connecting the door base 30 to the second connecting rod 72. In other words, if the angle $\alpha$ and the angle $\beta$ are equal to each other, the first connecting rod and the second connecting rod 72 are rotationally connected to the door base 30 at the same position. The angle $\alpha$ and the angle $\beta$ are set at, for example, 124° and 55° (including an actual error), respectively. The distance R is, for example, 36 mm (including an actual error) if a height from the first shaft 41 and the second shaft 42 to the pivot 20 of the door 3 is 48 mm and a distance between the first shaft 41 and the second shaft 42 is 72 mm.

In this configuration, as shown in FIG. 4, the first rotating plates 51, the second rotating plates 52, the synchronizing rods 60, the first connecting rods 71, and the second connecting rods 72 are symmetrically disposed about a center plane laterally extending in the housing 24. In other words, the pairs of the first rotating plates 51, the second rotating plates 52, the synchronizing rods 60, the first connecting rods 71, and the second connecting rods 72 are disposed so as to laterally hold the door base 30. The first shaft 41 and the second shaft 42 are disposed so as to penetrate the pair of first rotating plates 51 and the pair of second rotating plates 52, respectively. Furthermore, the first connecting pin 81 is disposed across the pair of first connecting rods 71 and the pair of first rotating plates 51, the first synchronizing pin 61 is disposed across the pair of first rotating plates 51 and the pair of synchronizing rods 60, the second connecting pin 82 is disposed across the pair of second connecting rods 72 and the pair of second rotating plates 52, and the second synchronizing pin 62 is disposed across the pair of second rotating plates 52 and the pair of synchronizing rods 60.

The operations of the flap gate 1 will be described below in accordance with the accompanying drawings.

Referring to FIGS. 6 to 9, the operations of the door base 30 and the axis positioning mechanism 21 in the flap gate 1 will be mainly discussed below for the sake of simplicity. In FIGS. 6 to 9, only the door base 30 and the axis positioning mechanism 21 are illustrated and other configurations are omitted.

Figure 6:
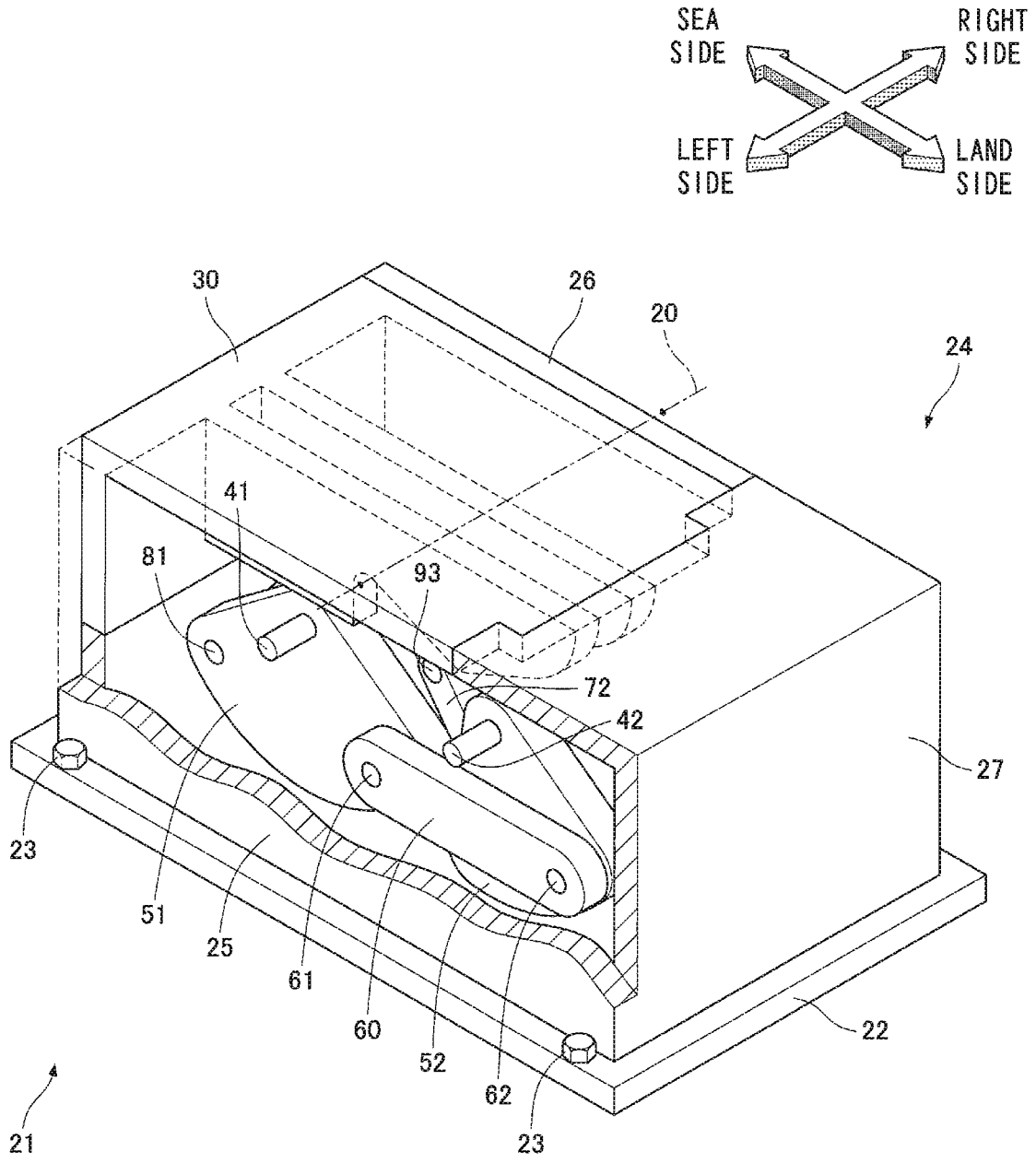
FIG. 6 is an enlarged perspective view for explaining the operations of a door base and the axis positioning mechanism in the flap gate, the door base being laid flat.
Figure 7:
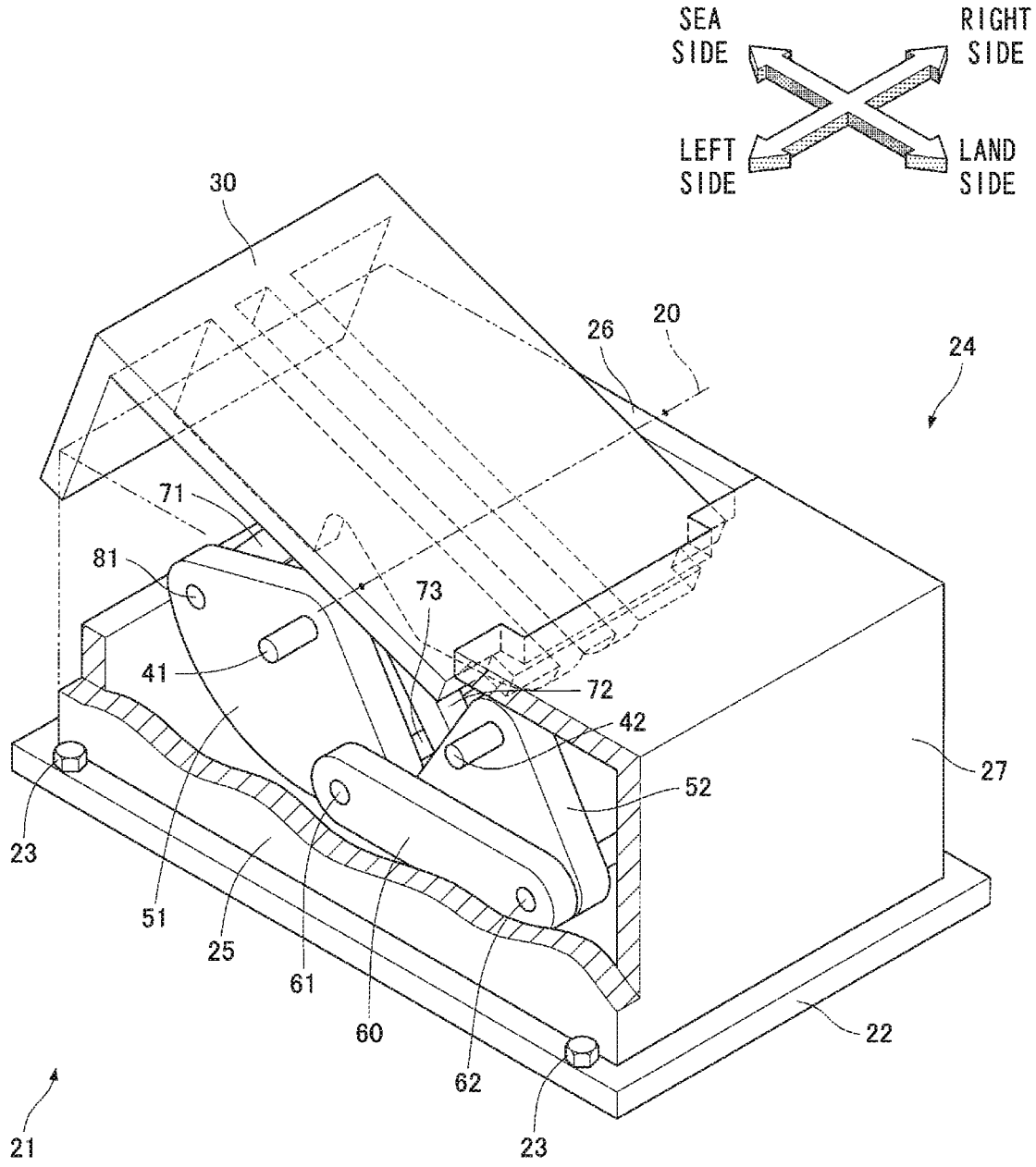
FIG. 7 is an enlarged perspective view for explaining the operations of the door base and the axis positioning mechanism in the flap gate, the door base being raised.
Figure 8:
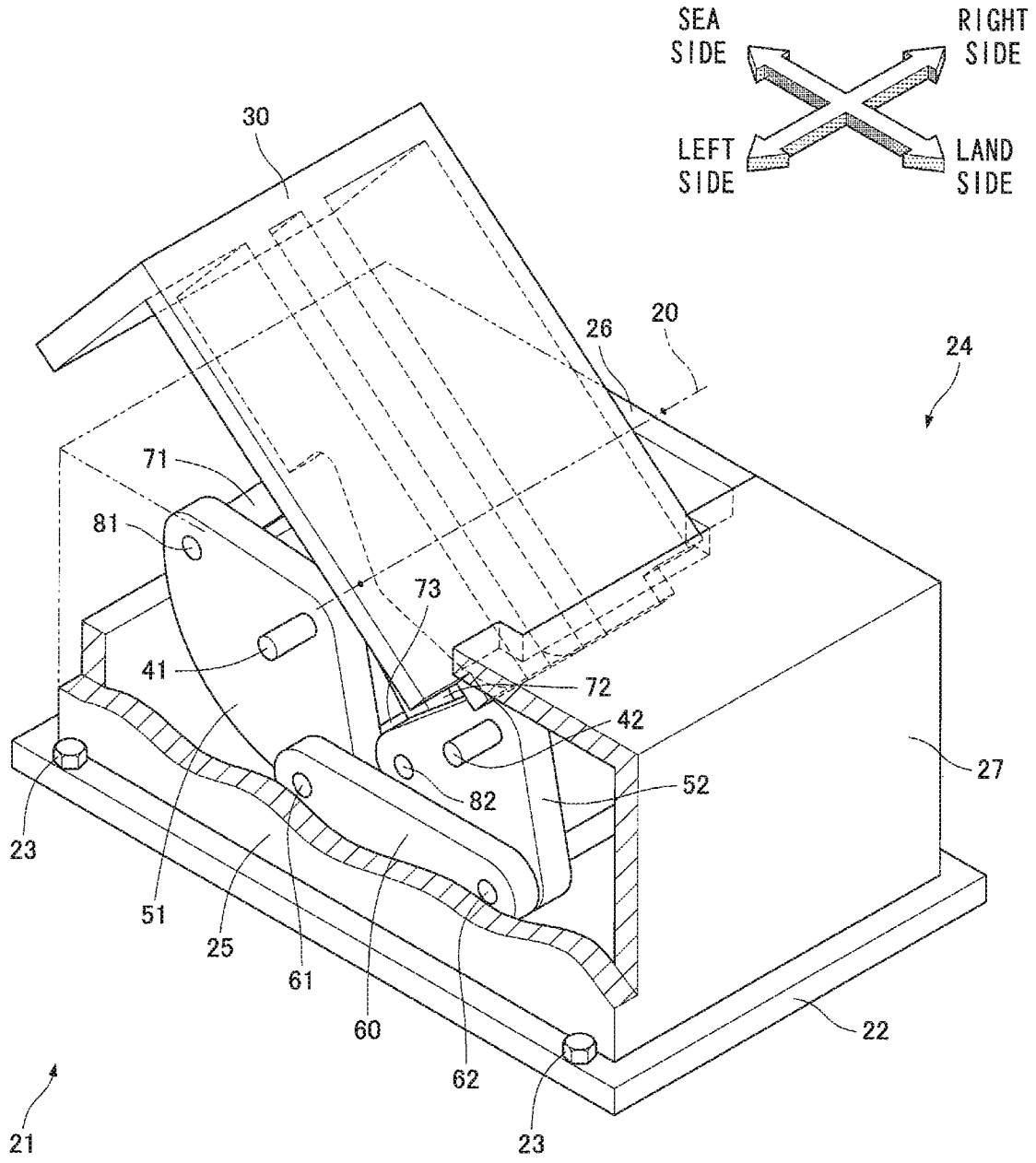
FIG. 8 is an enlarged perspective view for explaining the operations of the door base and the axis positioning mechanism in the flap gate, the door base being raised to a higher position.
Figure 9:
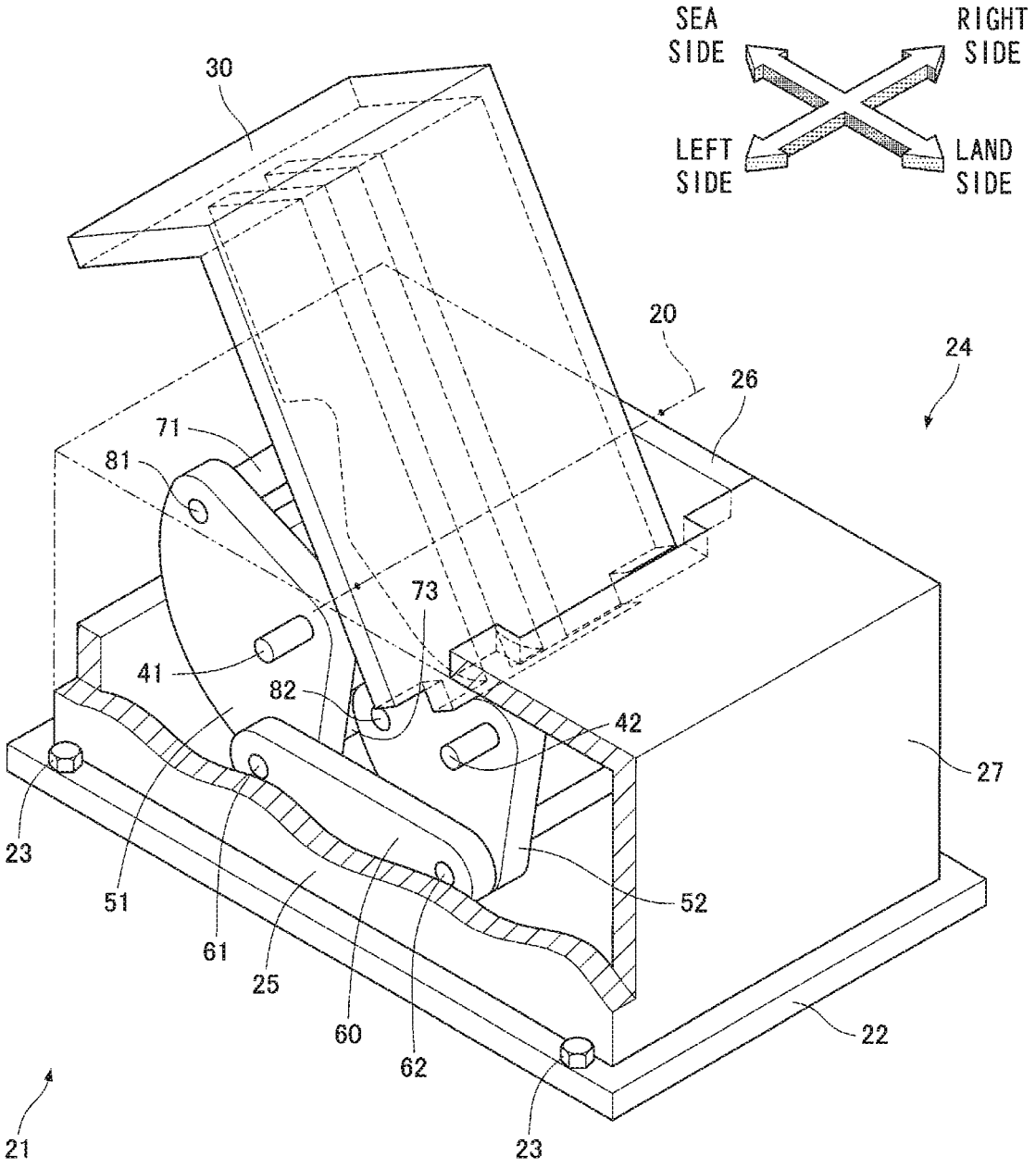
FIG. 9 is an enlarged perspective view for explaining the operations of the door base and the axis positioning mechanism in the flap gate, the door base being fully raised.

FIG. 6 shows the door base 30 laid flat with the door 3 under normal conditions. When the sea level S exceeds the road surface because of a tidal wave or a tsunami, as shown in FIG. 7, the door base 30 starts rising with the door 3. This allows the first connecting rods 71 connected to the door base 30 to start moving in the lifting direction of the first connecting pin 81, thereby starting the rotation of the first rotating plate 51. Thereafter, the synchronizing rods 60 synchronize the rotations of the first rotating plates 51 and the second rotating plates 52. In other words, the second rotating plate 52 starts rotating with the same angular velocity and in the same direction as the first rotating plate 51. When the second rotating plates 52 start rotating, the second connecting rods 72 start moving in the lifting direction of the door base 30 (specifically, the second door-side pin 92). When the first rotating plates 51 start rotating, the third connecting rod 73 connected to the first rotating plates 51 via the first synchronizing pin 61 moves in the descending direction of the door base 30 (specifically, the third door-side pin 93). The second door-side pin 92 is lifted while the third door-side pin 93 is lowered, so that the door base 30 starts rotating about the pivot 20 which is near or in the watertight rubber sheet 12. As shown in FIGS. 8 and 9, even if the door base 30 is further raised, the pivot 20 of the door base 30 is kept near or in the watertight rubber sheet 12. When the raised door 3 moves into laid flat, the door 3 is moved in the reverse steps and thus the pivot 20 of the door base 30 is kept near or in the watertight rubber sheet 12.

Thus, the rotation bearing (the axis positioning mechanism 21) of the flap gate 1 and the flap gate 1 eliminate the need for cutting the door base 30 and the substrate 2 with high accuracy during manufacturing, thereby simplifying the manufacturing process.

Moreover, when the door 3 is laid flat, the first shaft 41 is placed above the first connecting pin 81 and the first synchronizing pin 61 and the second shaft 42 is placed above the second connecting pin 82 and the second synchronizing pin 62. This allows the first rotating plates 51 and the second rotating plates 52 to receive the load of the door 3 at positions (the first connecting pin 81, the first synchronizing pin 61, the second connecting pin 82, and the second synchronizing pin 62) lower than positions (the first shaft 41 and the second shaft 42) where the rotating plates are supported by the housing 24, achieving a stable structure.

Furthermore, both ends of the first shaft 41 and the second shaft 42 are supported by the housing 24, thereby further stabilizing the structure.

Additionally, the first rotating plates 51, the second rotating plates 52, the synchronizing rods 60, the first connecting rods 71, and the second connecting rods 72 are symmetrically disposed about the center plane laterally extending in the housing 24, thereby further stabilizing the structure.

Second Embodiment

A flap gate 1 according to a second embodiment of the present invention will be described below in accordance with the accompanying drawings.

The flap gate 1 according to the second embodiment of the present invention is different from the flap gate 1 according to the first embodiment in that quite simple members are stored in a housing 24 in an axis positioning mechanism 21. Hereinafter, the members disposed in the housing 24 will be mainly described as differences from the first embodiment. The same configurations as those of the first embodiment are indicated by the same reference numerals and the explanation thereof is omitted.

Figure 10:
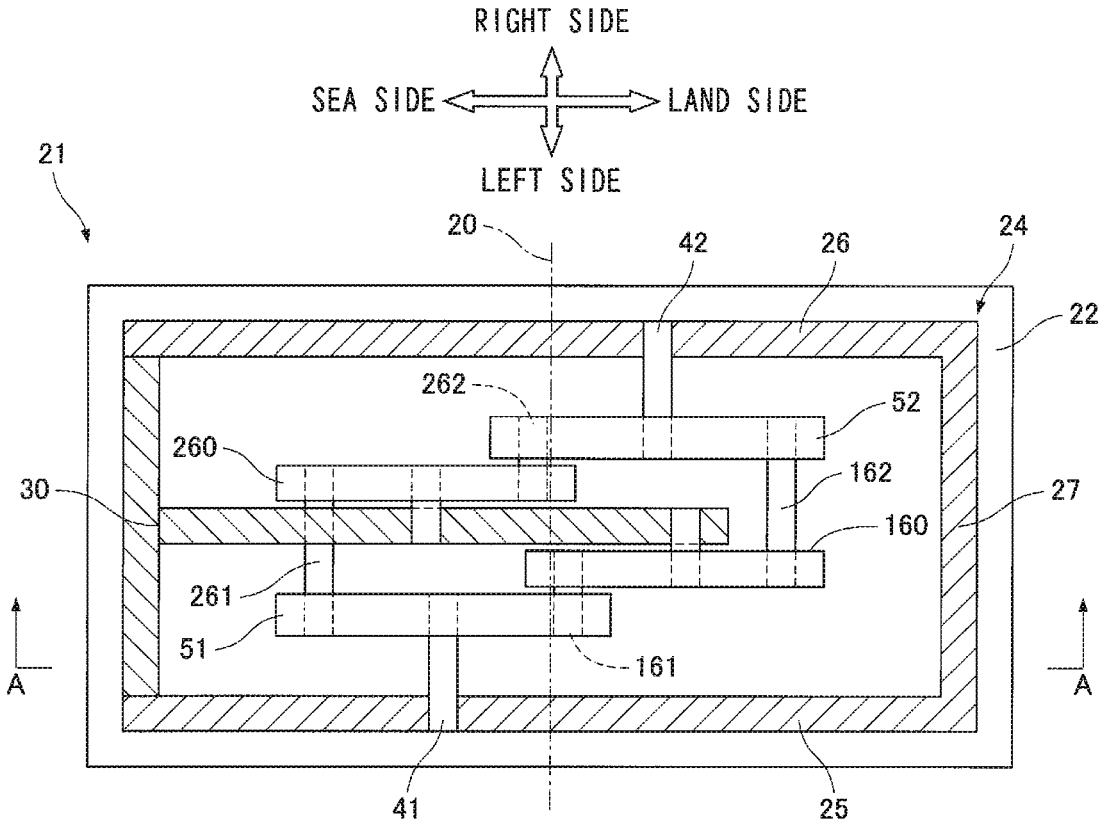
FIG. 10 is an enlarged plan view illustrating the interior of a housing in an axis positioning mechanism for a flap gate (under normal conditions) according to a second embodiment of the present invention.
Figure 11:
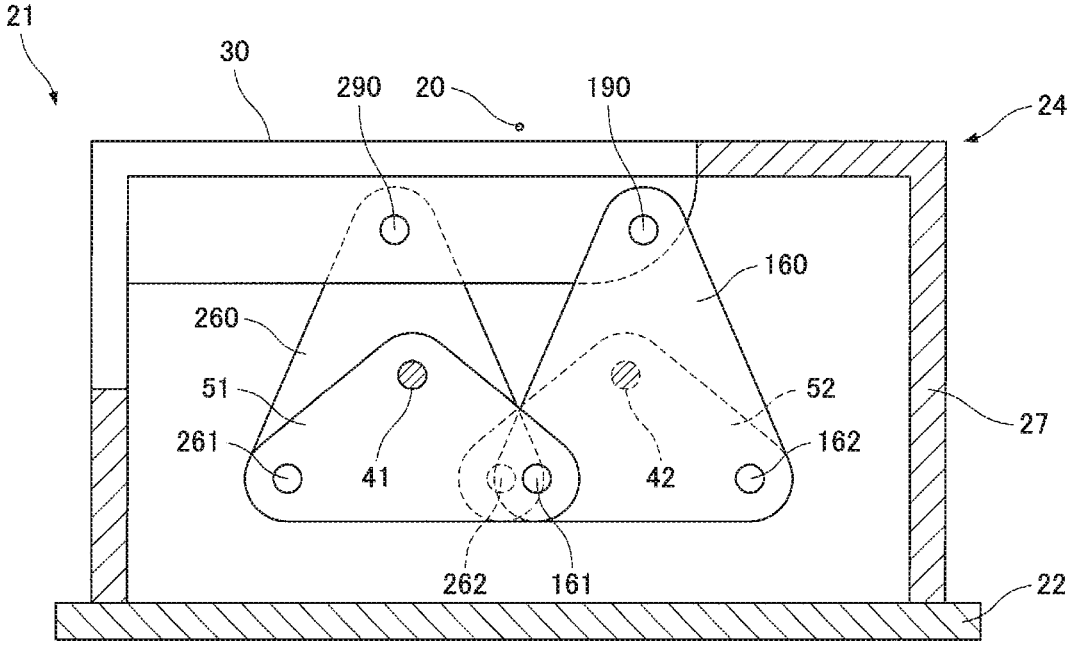
FIG. 11 is an A-A arrow view of FIG. 10.

As shown in FIGS. 10 and 11, the members stores in the housing 24 in the axis positioning mechanism 21 of the flap gate 1 according to the second embodiment of the present invention include a first shaft 41 with one end supported by a left plate 25 of the housing 24, a second shaft 42 with one end supported by a right plate 26 of the housing 24, a first rotating plate 51 (an example of a first rotating member) rotationally supported by the housing 24 via the first shaft 41, and a second rotating plate 52 (an example of a second rotating member) rotationally supported by the housing 24 via the second shaft 42. The first shaft 41 and the second shaft 42 have different axes but the axes are disposed in parallel with a pivot 20 of a door 3.

The members further include two synchronizing plates 160 and 260 (an example of a synchronizing member) that synchronize the rotation of the first rotating plate 51 about the first shaft 41 and the rotation of the second rotating plate 52 about the second shaft 42. The two synchronizing plates 160 and 260 include the land-side synchronizing plate 160 disposed near the first rotating plate 51 (left side) and on the land side and the sea-side synchronizing plate 260 disposed near the second rotating plate 52 (right side) and on the sea side. The land-side synchronizing plate 160 includes a first land-side synchronizing pin 161 that rotationally connects the first rotating plate 51 and a second land-side synchronizing pin 162 that rotationally connects the second rotating plate 52. The sea-side synchronizing plate 260 includes a first sea-side synchronizing pin 261 that rotationally connects the first rotating plate 51 and a second sea-side synchronizing pin 262 that rotationally connects the second rotating plate 52. The first land-side synchronizing pin 161, the second land-side synchronizing pin 162, the first sea-side synchronizing pin 261, and the second sea-side synchronizing pin 262 have different axes but the axes are disposed in parallel with the pivot 20 of the door 3. In order to synchronize the rotations of the first rotating plate 51 and the second rotating plate 52 by means of the two synchronizing plates 160 and 260, for example, a distance between the first shaft 41 and the first land-side synchronizing pin 161 is set equal to distance between the second shaft 42 and the second land-side synchronizing pin 162 and a distance between the first shaft 41 and the first sea-side synchronizing pin 261 is set equal to a distance between the second shaft 42 and the second sea-side synchronizing pin 262. In other words, even when the first rotating plate 51 and the second rotating plate 52 rotate, a line connecting the first shaft 41 and the second shaft 42, a line connecting the first land-side synchronizing pin 161 and the second land-side synchronizing pin 162, and a line connecting the first sea-side synchronizing pin 261 and the second sea-side synchronizing pin 262 are kept in parallel with one another. As a matter of course, as shown in FIGS. 10 to 13, a distance between the first shaft 41 and the first land-side synchronizing pin 161, a distance between the first shaft 41 and the first sea-side synchronizing pin 261, a distance between the second shaft 42 and the second land-side synchronizing pin 162, and a distance between the second shaft 42 and the second sea-side synchronizing pin 262 may be equal to one another.

The land-side synchronizing plate 160 and the sea-side synchronizing plate 260 include door-side pins 190 and 290, respectively, that rotationally connect a door base 30. The two door-side pins 190 and 290 have different axes but the axes are disposed in parallel with the pivot 20 of the door 3. In other words, it can be said that the door base 30 is rotationally connected to the first rotating plate 51 and the second rotating plate 52 with different axes (via the land-side synchronizing plate 160 and the sea-side synchronizing plate 260).

On the first rotating plate 51, the first shaft 41 is placed higher than the first land-side synchronizing pin 161 and the first sea-side synchronizing pin 261, the first land-side synchronizing pin 161 is placed on the land side of the first shaft 41 and the first sea-side synchronizing pin 261, and the first sea-side synchronizing pin 261 is placed on the sea side of the first shaft 41 and the first land-side synchronizing pin 161 while the door 3 is laid flat. On the second rotating plate 52, the second shaft 42 is placed higher than the second land-side synchronizing pin 162 and the second sea-side synchronizing pin 262, the second land-side synchronizing pin 162 is placed on the land side of the second shaft 42 and the second sea-side synchronizing pin 262, and the second sea-side synchronizing pin 262 is placed on the sea side of the second shaft 42 and the second land-side synchronizing pin 162 while the door 3 is laid flat. In the door base 30, the two door-side pins 190 and 290 are disposed at positions where a rotation about the pivot 20 and the rotations of the first rotating plate 51 and the second rotating plate 52 are synchronized with each other.

Referring to FIGS. 10 to 13, the operations of the flap gate 1 according to the second embodiment of the present invention will be described below.

Figure 12:
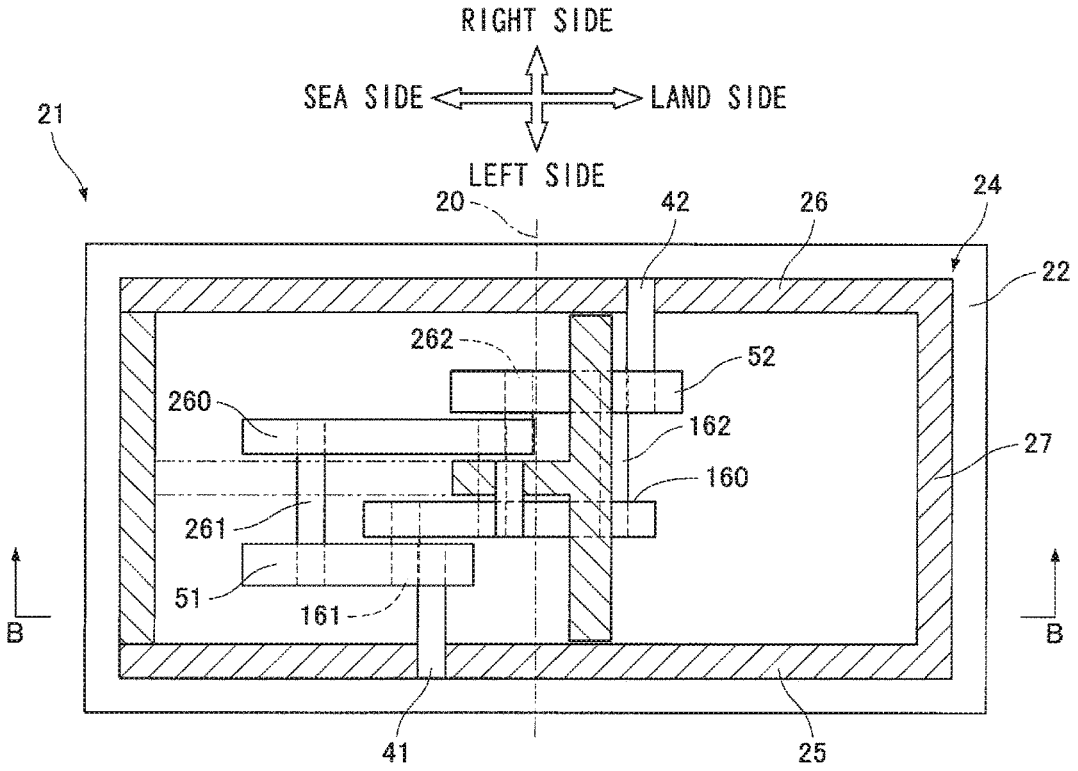
FIG. 12 is an enlarged plan view illustrating the interior of the housing in the axis positioning mechanism for the flap gate (under emergency conditions) according to the second embodiment of the present invention.
Figure 13:
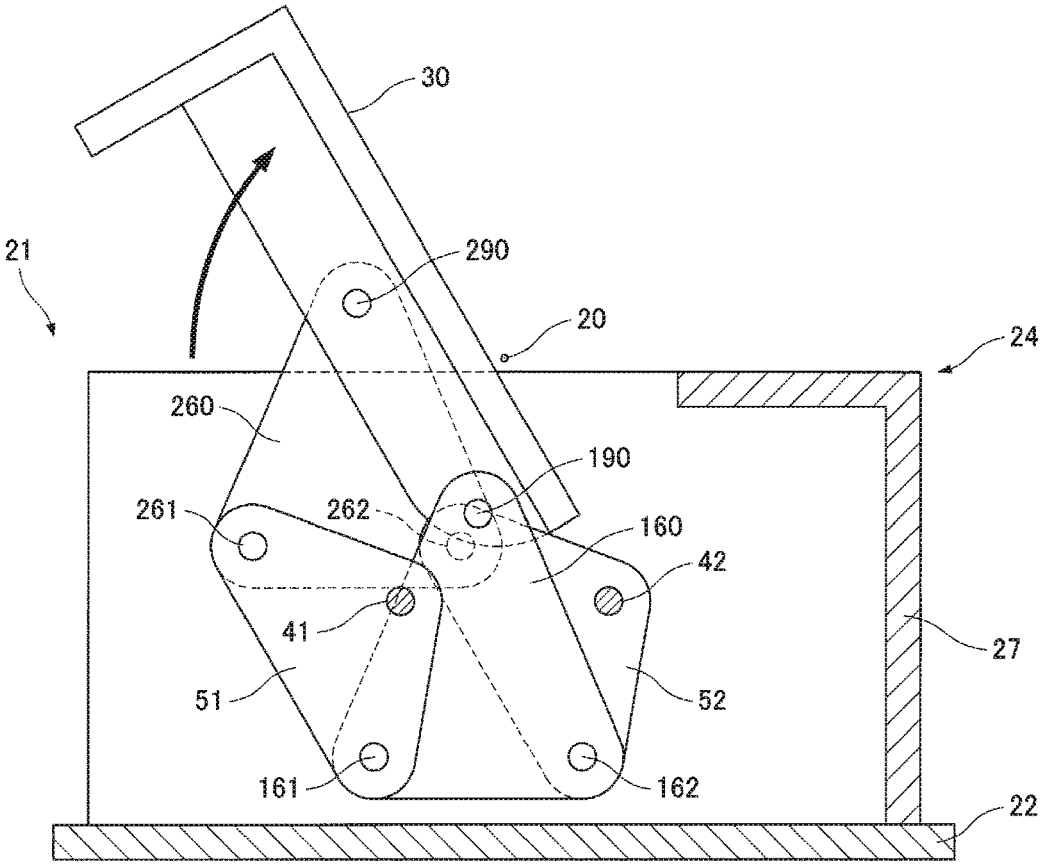
FIG. 13 is a B-B arrow view of FIG. 12.

FIGS. 10 and 11 show the door base 30 laid flat with the door 3 under normal conditions. When a sea level S exceeds a road surface because of a tidal wave or a tsunami, as shown in FIGS. 12 and 13, the door base 30 starts rising with the door 3. Thus, the sea-side synchronizing plate 260 connected to the door base 30 via the door-side pin 290 starts moving in the lifting direction of the first sea-side synchronizing pin 261 and the second sea-side synchronizing pin 262, so that the first rotating plate 51 and the second rotating plate 52 rotate in a synchronous manner. When the first rotating plate 51 and the second rotating plate 52 rotate, the land-side synchronizing plate 160 connected to the rotating plates via the first land-side synchronizing pin 161 and the second land-side synchronizing pin 162 moves in the descending direction of the door base 30 (specifically, the other door-side pin 190). The door-side pin 290 is lifted while the other door-side pin 190 is lowered, causing the door base 30 to rotate about the pivot 20 near or in the watertight rubber sheet 12. When the raised door 3 moves into laid flat, the door 3 is moved in the reverse steps and thus the pivot 20 of the door base 30 is kept near or in the watertight rubber sheet 12.

As has been discussed, the flap gate 1 according to the second embodiment can reduce the number of members stored in the housing 24 as compared with the flap gate 1 according to the first embodiment, achieving a simpler manufacturing process in addition to the effect of the first embodiment.

In the first and second embodiments, the first rotating plate 51 and the second rotating plate 52 were described as examples of the first rotating member and the second rotating member. The rotating members may be any members other than plates. Furthermore, as examples of the synchronizing members, the synchronizing rod 60 was discussed in the first embodiment and the land-side synchronizing plate 160 and the sea-side synchronizing plate 260 were discussed in the second embodiment. The synchronizing members may be any other members.

Moreover, the watertight rubber sheet 12 was described as an example of a watertight elastic sheet in the first and second embodiments. The watertight elastic sheet may be a replacement of the watertight rubber sheet 12 for ensuring watertightness.

The first and second embodiments are merely exemplary and are not restrictive in all the aspects. The scope of the present invention is not indicated by the foregoing description but the claims. The scope of the present invention is intended to include meanings equivalent to the claims and all changes in the scope. Among the configurations described in the first and second embodiments, the configurations other than those described in the claims are optional and thus can be deleted and changed as appropriate.

The invention claimed is:

1. A rotation bearing of a flap gate provided at an opening of a structure, the rotation bearing comprising:

a housing disposed at a bottom of the opening;

a door base disposed at a flapping door of the flap gate;

a first rotating member rotationally supported by the housing via a first shaft;

a second rotating member rotationally supported by the housing via a second shaft having a different axis from the first shaft;

a synchronizing member rotationally connected to the first rotating member and the second rotating member so as to synchronize rotations of the first rotating member and the second rotating member; and connecting members that rotationally connect the door base to the first rotating member and the second rotating member with different axes, wherein the door is laid flat with a pivot of the door at a higher position than one of the axes for rotationally connecting the connecting members to the door base, and wherein a position of the pivot of the door relative to the housing remains constant upon flapping of the door.

2. A rotation bearing of a flap gate provided at an opening of a structure, the rotation bearing comprising:

a housing disposed at a bottom of the opening;

a door base disposed at a flapping door of the flap gate;

a first rotating member rotationally supported by the housing via a first shaft;

a second rotating member rotationally supported by the housing via a second shaft having a different axis from the first shaft;

a synchronizing member rotationally connected to the first rotating member and the second rotating member so as to synchronize rotations of the first rotating member and the second rotating member; and connecting members that rotationally connect the door base to the first rotating member and the second rotating member with different axes, wherein the door is laid flat with a pivot of the door at a higher position than one of the axes for rotationally connecting the connecting members to the door base, the rotation bearing further comprising:

a first connecting member rotationally connecting the door base and the first rotating member;

a second connecting member rotationally connecting the door base and the second rotating member; and a third connecting member rotationally connecting the door base and the first rotating member and the synchronizing member at a different position from the first connecting member, wherein the door base and the first connecting member are connected via a first door-side pin while the first rotating member and the first connecting member are connected via a first connecting pin, the door base and the second connecting member are connected via a second door-side pin while the second rotating member and the second connecting member are connected via a second connecting pin, the door base and the third connecting member are connected via a third door-side pin while the first rotating member and the third connecting member and the synchronizing member are connected via a first synchronizing pin, the second rotating member and the synchronizing member are connected via a second synchronizing pin, an angle formed by the first door-side pin, the pivot of the door, and the third door-side pin is set equal to an angle formed by the first connecting pin, the first shaft, and the first synchronizing pin, an angle formed by the second door-side pin, the pivot of the door, and the third door-side pin is set equal to an angle formed by the second connecting pin, the second shaft, and the second synchronizing pin, and a distance between the pivot of the door and the second door-side pin and the third door-side pin is set equal to a distance between the first shaft and the first synchronizing pin and a distance between the second shaft and the second connecting pin and the second synchronizing pin.

3. The rotation bearing of the flap gate according to claim 2, wherein a distance between the pivot of the door and the first door-side pin, the second door-side pin, and the third door-side pin is set equal to a distance between the first shaft and the first connecting pin and the first synchronizing pin and a distance between the second shaft and the second connecting pin and the second synchronizing pin.

4. A rotation bearing of a flap gate provided at an opening of a structure, the rotation bearing comprising:

a housing disposed at a bottom of the opening;

a door base disposed at a flapping door of the flap gate;

a first rotating member rotationally supported by the housing via a first shaft;

a second rotating member rotationally supported by the housing via a second shaft having a different axis from the first shaft a synchronizing member rotationally connected to the first rotating member and the second rotating member so as to synchronize rotations of the first rotating member and the second rotating member; and connecting members that rotationally connect the door base to the first rotating member and the second rotating member with different axes, wherein the door is laid flat, with a pivot of the door at a higher position than one of the axes for rotationally connecting the connecting members to the door base, wherein one of the connecting members is the synchronizing member, and wherein said one of the connecting members is rotationally connected to the first rotating member by a first synchronizing pin, rotationally connected to the second rotating member by a second synchronizing pin, and rotationally connected to the door base by a door-side pin.

5. The rotation bearing of the flap gate according to claim 4, wherein a position of the door-side pin relative to the first synchronizing pin and the second synchronizing pin remain constant upon flapping of the door.

6. The rotation bearing of the flap gate according to claim 1, wherein the first and second shafts are placed above a position where the first rotating member and the second rotating member are rotationally connected to the synchronizing member while the door is laid flat.

7. The rotation bearing of the flap gate according to claim 1, wherein the first shaft and the second shaft have both ends supported by the housing.

8. A flap gate comprising:

the rotation bearing of the flap gate according to claim 1;

a substrate provided at the bottom of the opening;

the door configured with the door base so as to flap with respect to the substrate; and a watertight elastic sheet disposed from the door base to the substrate.

9. The rotation bearing of the flap gate according to claim 1, further comprising: a watertight rubber sheet, one side of the watertight rubber sheet being fixed to the door by a door-side cross arm brace disposed on the door base, and another side of the watertight rubber sheet being fixed to a substrate by a cross arm brace disposed on the substrate.

10. The rotation bearing of the flap gate according to claim 9, wherein the pivot is located in or near the watertight rubber sheet.

11. The rotation bearing of the flap gate according to claim 1, wherein the pivot of the door extends parallel with the first shaft and the second shaft.

* * * * *